United States Patent [19]

Bertini et al.

[11] Patent Number: 4,725,241

[45] Date of Patent: Feb. 16, 1988

[54] MOLDED ELECTRICAL JACK ASSEMBLY

[75] Inventors: Carlo Bertini, Moncalieri; Gianfranco D'Urso, Turin, both of Italy

[73] Assignee: AMP Incorporated, Harrisburg, Pa.

[21] Appl. No.: 2,092

[22] Filed: Jan. 12, 1987

[30] Foreign Application Priority Data

Jan. 15, 1986 [GB] United Kingdom ..... 8600831

[51] Int. Cl.[4] ..... H01R 13/703

[52] U.S. Cl. ..... 439/188; 200/51.1

[58] Field of Search ..... 339/19, 75 M, 75 MP, 339/176 M; 200/51 R, 51.09, 51.1; 439/188

[56] References Cited

U.S. PATENT DOCUMENTS 4,233,478 11/1980 Stahl et al. ..... 200/51.09

4,426,558 1/1984 Tanaka et al. ..... 200/51.09

FOREIGN PATENT DOCUMENTS 1239385 4/1967 Fed. Rep. of Germany .

*Primary Examiner*—Neil Abrams

*Attorney, Agent, or Firm*—William B. Noll

[57] ABSTRACT

An electrical connector for a telephone system comprises a housing moulded in one piece from insulating material with a plug receiving cavity opening at a plug receiving mouth at a front mating face of the housing, a row of spring contacts anchored in a housing cavity wall to extend into the cavity so that the contacts will be resiliently engaged by respective contacts of a complementary plug when inserted through the mouth into the cavity. A compartment with a contact set extends alongside and opens into the plug receiving cavity. A cam integrally formed with a wall of the cavity extends into the plug receiving cavity into the insertion path of a plug, which will, on insertion, urge the cam through the opening and into the compartment, moving the contacts of the contact set relatively apart and breaking the circuit.

6 Claims, 6 Drawing Figures

MOLDED ELECTRICAL JACK ASSEMBLY

The invention relates to electrical connector sockets particularly for use in the telecommunications industry.

Such connectors may comprise a housing moulded in one piece from insulating material with a plug receiving cavity opening at a front mating face of the housing at a plug receiving mouth, a row of spring contact arms being anchored in a housing cavity wall to extend into the cavity so that the contact arms will be resiliently engaged by respective contacts of a complementary plug when inserted through the mouth into the cavity.

Where, for example, a shared line is proposed in domestic telephone circuits, there is a requirement for an additional, normally closed, telephone circuit to be opened by the insertion of a plug into the jack preventing another party using the shared line.

It has been proposed in an electrical connector as shown in Federal Republic of Germany Disclosure Document No. 1239385 to provide a compartment extending alongside and opening into the plug receiving cavity, a contact set mounted in the compartment and having contacts in a first switching condition, a cam extending into the plug receiving cavity into the insertion path of a plug such that, on insertion into the mouth, the plug will engage the cam, urging the cam through the opening and into the compartment and causing deflection of one contact of the set relative to the other contact of the contact set, thereby to change the switching condition.

The contact set may include a spring arm which will be deflected away from the other contact of the set by the cam while the plug remains in the cavity, maintaining the open circuit, and will resile back against the other contact of the set to close the circuit on withdrawing the plug from the cavity.

Disadvantages of the prior connectors are that it cannot be produced most economically using a minimum number of parts and relatively simple, straight-draw moulding techniques.

Problems also arise in reaching a reliable design in view of the difficulties inherent in the moulding and assembly of relatively small plastics parts requiring the accommodation of moulding tolerances, both in the plug and jack, and in consequence, a relatively large displacement of the cam member to render such tolerances insignificant. In addition, in a switchboard, it is necessary for all contacts to project from the rear face of the housing, for example, for connection to a printed circuit board.

According to the invention, the cam is formed with a wall portion of the cavity to which it is integrally joined by a web hinge, thus reducing the required number of parts. Such wall portion preferably extends between the cavity and the compartment, and preferably, from the mating face, enabling a simple construction.

At a location adjacent the mating face, the wall portion may be integrally formed at respective opposite sides with internal surfaces of opposite side walls of the cavity and have a rearwardly extending part free of such surfaces to form the flexible web hinge carrying the cam portion which has a cam surface on one side extending into the cavity across the insertion path of a plug and a lug on the opposite side extending into the compartment into engagement with the contact set spring arm.

The envelope defined by the profile of the cam in the inssertion direction may be located opposite an opening in the rear of the jack housing during moulding, enabling the housing to be formed by relatively simple and economical straight-draw moulding techniques.

Desirably, the contact set spring arm comprises a resilient metal strip portion extending forwardly along the compartment remote from the cam portion toward the mating face from a root end fixed in a rear wall portion of the housing and reversely bent adjacent the mating face to extend rearwardly adjacent the cam portion to present a first contact surface at the free end and a portion spaced from the free end in engagement with the lug, the other contact of the contact set extending forwardly along the compartment from the rear wall to provide a further contact surface laterally aligned with and between the first contact surface and the cam portion.

Insertion of a plug into the cavity causes the cam portion to pivot on the web hinge towards the compartment with deflection of the free end of the contact set spring arm by the lug away from the other contact, disengaging the contact surfaces to break the circuit.

The reversely bent configuration of the contact set spring arm enables a soft and very reliable spring action to be obtained, accommodating the relatively large displacement of the cam desirable to accommodate manufacturing tolerances arising from moulding and contact assembly.

An example of an electrical connector of the type known as a modular jack according to the invention will now be described with reference to the accompanying drawings in which.

Figure 1:
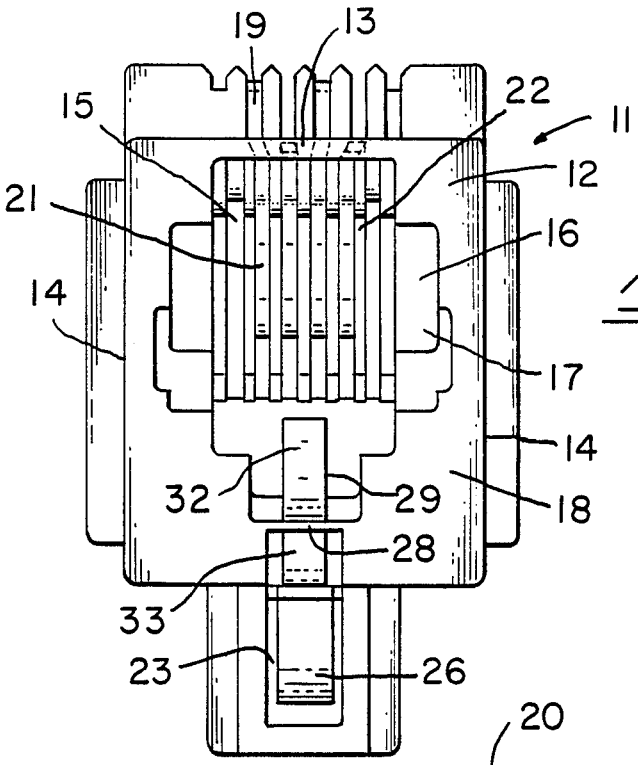
FIG. 1 is a front elevation of a modular jack according to the invention.
Figure 2:
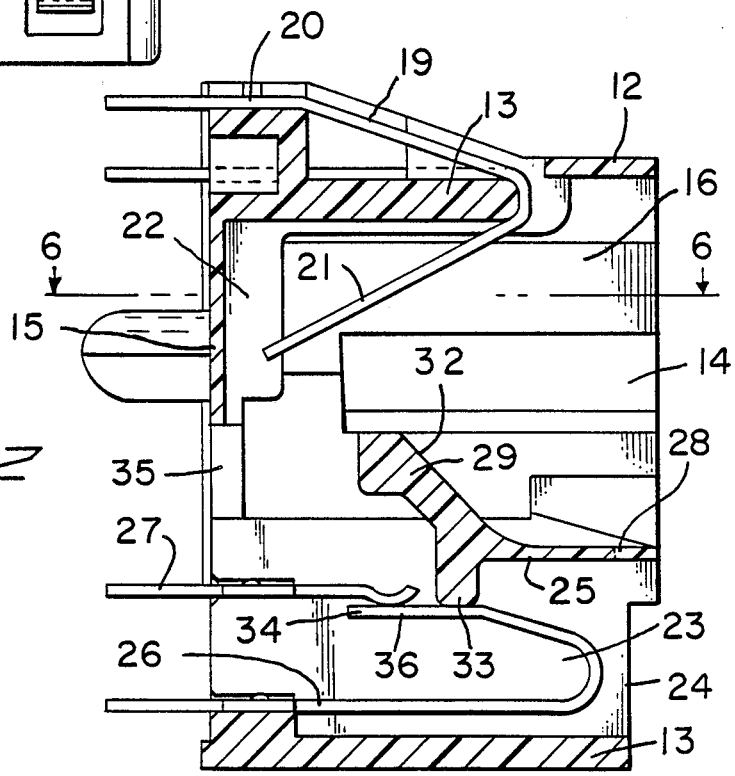
FIG. 2 is a cross-sectional view taken along line 2—2 in FIG. 1.

The modular jack 11 comprises a housing 12 moulded in one piece from insulating plastics material having pairs of opposed, spaced side walls 13 and 14, respectively, extending forwardly from a rear base wall 15 to define a plug receiving cavity 16 open at plug receiving mouth 17 at a front mating face 18 of the housing. A series of spring contact arms 19 have post portions 20 anchored in known manner in staggered relation in respective grooves in the exterior of side wall 13 and extend in a row through an aperture in the side wall, into and across the cavity, with free ends 21 freely received in locating grooves 22 formed in the rear wall 15 of the housing in known manner for resilient engagement with contacts of a conventional plug 37 (FIG. 3) of complementary profile to the mouth 17.

An additional compartment 23 is formed in the housing to extend forwardly from the rear wall 15 alongside the plug receiving cavity and has an opening 24 at the mating face and communicates laterally with the plug receiving cavity.

A wall portion 28 extends between the cavity 16 and compartment 23 being integrally joined to inwardly stepped surfaces of walls 14 at locations adjacent the mating face, but a rearwardly extending portion 29 is free of those surfaces forming a web hinge 25 which carries at a rear end a cam portion 31 formed on one side with a can surface 32 which extends obliquely into the cavity into the insertion path of the plug, the opposite side being formed with a lug 33 projecting into the compartment 23.

Prior to assembly with contacts, the envelope defined by the profile of the cam in the direction of plug insertion is opposite an aperture 35 in the housing rear wall 15 to facilitate the moulding of the housing.

An additional contact set is located in the compartment and comprises two cantilever spring contact arms 26 and 27, respectively, force fitted into respective pairs of aligned grooves extending forwardly from the rear in the inwardly stepped surfaces of walls 14. One arm 26 comprises a metal strip portion which extends forwardly along the compartment and is reversely bent adjacent the face towards the cavity to extend rearwardly adjacent the cam portion, providing a contact surface 36 at a free end 34 and a portion spaced from the free end in engagement with the lug. The other arm 27 extends in a plane between the rearwardly extending portion of the one arm and the wall portion 28 into engagement with the free end 34 of the arm. The one arm 26 is normally biased towards the other arm 27, retaining the contact surface 36 in contact with a contact surface of the other arm prior to plug insertion and biasing the cam portion surface towards the cavity.

Figure 3:
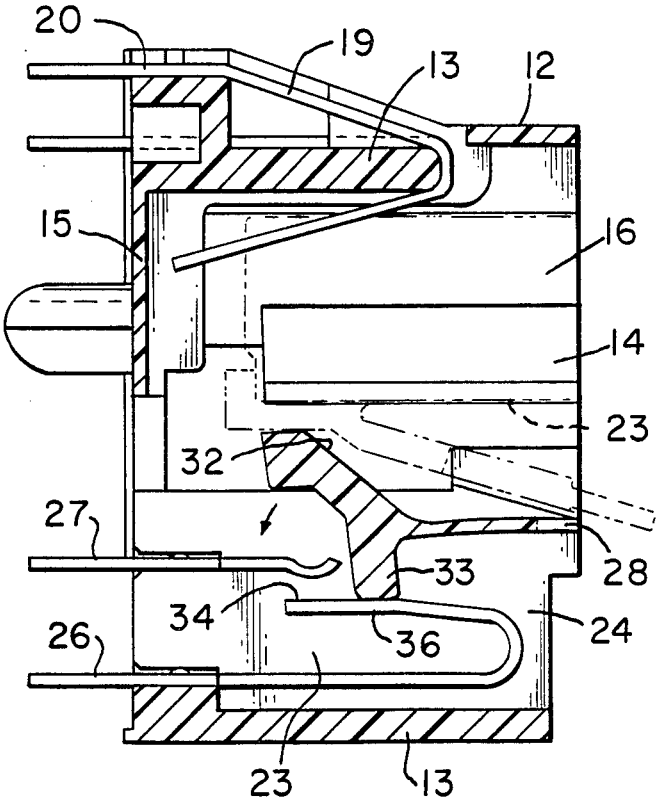
FIG. 3 is a similar view to FIG. 2 with a plug inserted into the jack opening the contact set.
Figure 4:
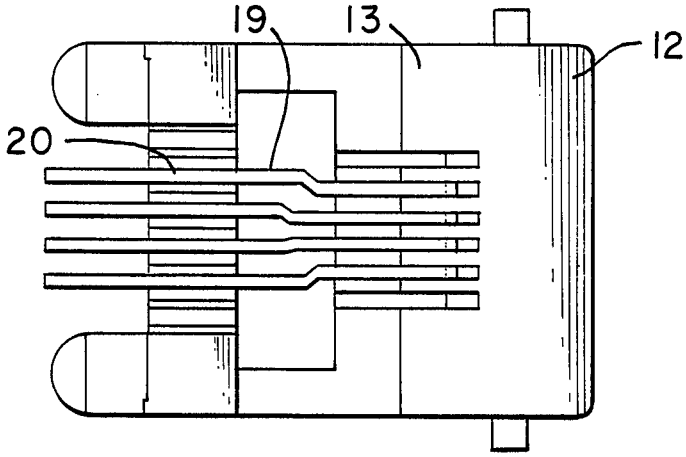
FIG. 4 is a plan view of the modular jack.
Figure 5:
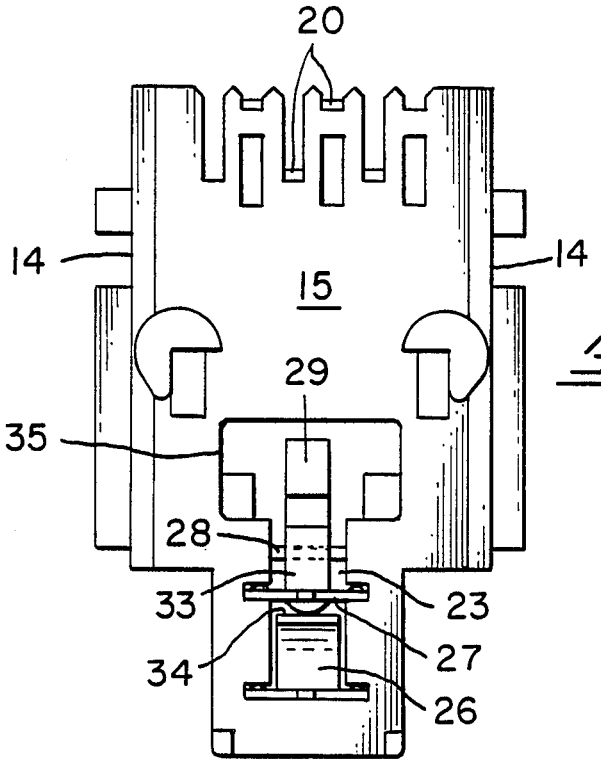
FIG. 5 is a rear elevation.
Figure 6:
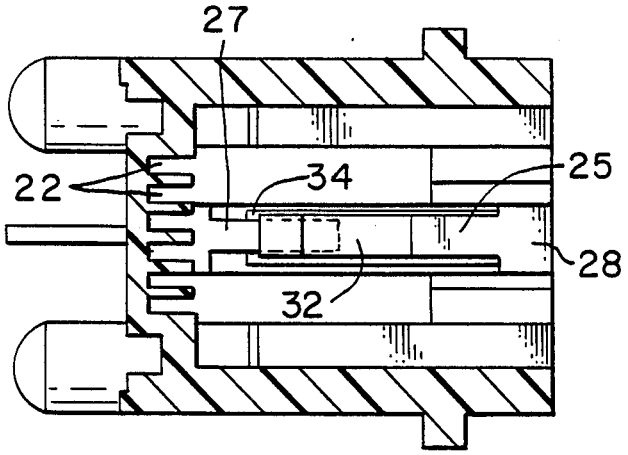
FIG. 6 is a cross-sectional view taken along lines 6—6 of FIG. 2 with contact detail omitted.

As shown in FIG. 3, insertion of the plug into the cavity bringing the respective plug and spring contact arm 14 into engagement causes deflection of the cam portion towards the end of the insertion movement about as axis perpendicular to the direction of plug insertion so that the lug 33 deflects the free end of the contact arm away from the other contact arm moving the contact surfaces apart to break the connection. Removal of the plug permits the cam portion to be returned into the cavity by the resilient force of the contact spring 26 which returns into engagement with contact 27, closing the circuit.

It will be noted that the jack of the invention is relatively economical to manufacturing, being of few parts, in particular as the cam is integrally formed with the cavity walls, and as the housing can be moulded using a simple straight-draw moulding technique, while a standard plug interface can be maintained without interference by the provision of the cam structure and contact set.

We claim:

1. An electrical connector comprising a housing molded in one piece from insulating material with a plug receiving cavity opening at a plug receiving mouth at a front mating face of the housing, a row of contacts anchored in a housing cavity wall to extend into the cavity so that the contacts will be engaged by respective contacts of a complementary plug when inserted through the mouth into the cavity, a compartment formed by the molded housing and extending alongside the plug receiving cavity, an opening extending between the compartment and the plug receiving cavity, a contact set mounted in the compartment and having contacts in a first switching condition, a cam integrally molded with the housing and extending into both said compartment and the insertion path of a plug in the said plug receiving cavity such that, on insertion into the mouth, the plug will engage the cam urging the cam through the opening and further into said compartment and causing deflection of one contact of the set relative to the other contact of the contact set thereby to change the switching condition, characterized in that the cam is formed with a wall portion of the cavity to which it is integrally joined by a flexible web hinge, where said cam is pivotal about said hinge in a direction essentially perpendicular to said plug insertion path.

2. An electrical connector according to claim 1, characterised in that movement of the cam through the opening causes relative movement apart of the contacts to break the circuit.

3. An electrical connector according to claim 1, characterized in that the wall portion to which the cam is integrally joined extends as a divider between the cavity and the compartment in the direction of plug insertion.

4. An electrical connector according to claim 3, characterised in that the wall portion extends rearwardly from the mating face and, at a location adjacent the mating face, the wall portion is integrally formed at respective opposite sides with internal surfaces of opposite side wals of the cavity and has a rearwardly extending part free of such surfaces, forming the flexible web hinge carrying the cam portion which has a cam surface on one side extending into the cavity across the insertion path of a plug and a lug on the opposite side extending into the compartment into engagement with the contact, the pivotal axis of the web hinge extending perpendicularly to the direction of plug insertion.

5. An electrical connector assembly according to claim 1, characterised in that the envelope defined by the profile of the cam in the plug insertion direction is located opposite an opening in the rear of the jack housing during moulding, enabling the housing to be formed by a relatively simple straight-draw moulding technique.

6. An electrical connector assembly according to claim 4, characterised in that the contact of the contact set comprises a resilient metal strip portion extending forwardly along the compartment remote from the cam towards the mating face from a foot end fixed in a rear wall portion of the housing and reversely bent adjacent the mating face to extend rearwardly adjacent the cam to present a first contact surface at the free end and a portion spaced from the free end in engagement with the lug.

* * * * *